United States Patent [19]

Stepantsov et al.

[11] 4,166,375

[45] Sep. 4, 1979

[54] HIGH-SPEED EXPLOSIVE HAMMER

[76] Inventors: Georgy K. Stepantsov, ulitsa Belinskogo, 21, kv. 36; Valentin S. Abramov, ulitsa Dekabristov, 191-91, both of Kazan; Jury N. Bloschitsyn, Yasenevo, mikroraion 1, korpus 1, kv. 141, Moscow; Raif R. Zaripov, ulitsa Gvardeiskaya, 24, kv. 74, Kazan; Alexandr A. Babko, ulitsa Sotsialisticheskaya, 3-20, Kazan; Ferdinand K. Kutlin, ulitsa Mirnaya, 61, kv. 75, Kazan; Ivan V. Glazunov, ulitsa Serova, 35, kv. 136, Kazan; Alexei A. Nilov, ulitsa Serova, 35, kv. 17, Kazan; Gennady V. Kuznetsov, ulitsa Vosstania, 56, kv. 114, Kazan; Petr A. Viter, 4 Sojuznaya ulitsa, 71, kv. 2, Kazan; Alexandr F. Pavlov, ulitsa Dekabristov, 199, kv. 2, Kazan; Valery M. Belonog, ulitsa Belinskogo, 19, kv. 7, Kazan; Vladimir A. Korneev, ulitsa Dekabristov, 164/31, kv. 71, Kazan; Emilia I. Zvereva, ulitsa Oktyabrskaya, 15, kv. 17,, Kazan, all of U.S.S.R.

[21] Appl. No.: 891,151

[22] Filed: Mar. 28, 1978

[51] Int. Cl.[2] ..... B21J 7/26

[52] U.S. Cl. ..... 72/430; 72/453.18

[58] Field of Search ..... 72/430, 453.01, 453.02, 72/453.18; 29/421 E; 173/134

[56] References Cited

U.S. PATENT DOCUMENTS

| | | | |
|---|---|---|---|
| 3,044,452 | 7/1962 | McCrory | 173/134 |
| 3,205,790 | 9/1965 | Bollar | 173/134 |
| 3,296,853 | 1/1967 | Beche | 72/453.01 |
| 3,552,181 | 1/1971 | Chan | 72/430 |
| 3,827,278 | 8/1974 | Mershon | 29/421 E |

FOREIGN PATENT DOCUMENTS

| | | | |
|---|---|---|---|
| 1112182 | 5/1968 | United Kingdom | 72/430 |
| 1205556 | 9/1970 | United Kingdom | 72/453.1 |
| 1315448 | 5/1973 | United Kingdom | 72/453.1 |
| 1371553 | 10/1974 | United Kingdom | 72/430 |
| 267308 | 5/1971 | U.S.S.R. | 72/430 |
| 420376 | 8/1974 | U.S.S.R. | 72/430 |

*Primary Examiner*—C. W. Lanham
*Assistant Examiner*—Gene P. Crosby
*Attorney, Agent, or Firm*—Fleit & Jacobson

[57] ABSTRACT

The invention relates to metal forming equipment and may be most advantageously used for the manufacture of single-tailed blades preferably for gas turbine engines. The hammer according to the invention has a stationary bed incorporating a load bearing frame carrying a lower die and a hammer cylinder. The hollow piston rod of the hammer cylinder accommodates a hammer body with an upper die, and its upper chamber is an explosion chamber. The invention resides in that the hammer body is mounted in the inner space of the hollow piston for an independent axial movement relative thereto under the action of a hammer piston arranged thereabove in the same inner space. The hammer piston is caused to move by pressure of gases released upon a blow-up in the explosion chamber. The chamber communicates with the inner space of the piston rod through a central opening of the piston. This construction considerably enlarges the manufacturing capabilities of the hammer according to the invention.

13 Claims, 5 Drawing Figures

HIGH-SPEED EXPLOSIVE HAMMER

FIELD OF APPLICATION

The invention relates to the metal forming equipment, and more particularly, to high-speed explosive hammers.

The invention may be most advantageously used in high-speed explosive hammers to be employed for the manufacture of single-tailed blades of low-ductility and difficult to deform metals and alloys, such as gas turbine blades of refractory titanium alloys.

BACKGROUND OF THE INVENTION

Known in the art are high-speed explosive hammers having a stationary bed incorporating a load bearing frame supporting a lower die and a hammer cylinder having a hollow piston rod carrying a hammer body having an upper die coaxial with the lower die, the upper piston chamber of said main hammer cylinder comprising an explosion chamber.

In the prior art hammers, the hammer body comprising a slab is rigidly fixed to the free end of the hollow piston rod and has relatively large mass, and a width which is greater than the width of the lower die. Therefore, the blank being treated is acted upon by the mass which is equal to a sum of masses of the piston, piston rod and the hammer body with the upper die. The piston and the hollow piston rod are moved during the work stroke under the action of pressure of gases released upon a blow-up of an explosive in the explosion chamber.

The piston is returned back into the initial position by means of two hydraulic cylinders mounted in the bottom portion of the load bearing frame. Piston rods of these cylinders bear with their free ends against the lower side of the slab upon liting the piston to the initial position thereby defining relatively large width of the slab, hence its great mass.

To provide optimum conditions for the manufacture of high-grade details by high-speed extrusion, pre-set values of velocity and impact energy should be ensured which are determined by density and ductility of the material of a blank being treated, as well as by shape and size of the part.

In known hammers, required impact energy may be obtained by selecting appropriate components of an explosive and the value of pressure under which the explosive is fed to the explosion chamber. It is, however, impossible to provide relatively high impact velocity with relatively small value of impact energy required for the manufacture of small parts due to comparatively large mass of elements acting on the blank upon deformation thereof. It is also impossible to provide relatively small impact energy with relatively high impact velocity in the manufacture of the same parts.

Therefore, prior art hammers cannot provide for the manufacture of parts of varying size thus limiting the manufacturing capabilities of such hammers.

BRIEF DESCRIPTION OF THE INVENTION

The main object of the invention is to enlarge the manufacturing capabilities of high-speed explosive hammer.

This and other objects are accomplished by that in a high-speed explosive hammer having a stationary bed incorporating a load bearing frame carrying a lower die and a hammer cylinder having an upper chamber which is used as an explosive chamber, the hollow piston rod of this cylinder carrying a hammer body having an upper die coaxial with the lower die, according to the invention, the hammer body is mounted in the inner space of the piston rod for an independent axial movement relative thereto caused by a hammer piston accommodated in the same inner space which is caused to move under the action of gases released upon a blow-up in an explosion chamber communicating with the inner space of the piston rod through a central opening provided in the piston.

The hammer body preferably comprises a piston of an auxiliary hammer cylinder fixed to the hollow piston rod of the main hammer cylinder in such a manner that the upper chamber of the auxiliary hammer cylinder is an extension of the inner space of the piston rod which is communicatable with an air line for returning the hammer piston back into the initial position, and a lower chamber of the auxiliary hammer cylinder communicates with the air line for returning its piston back into the initial position. The main hammer cylinder has an axially adjustable body. For that purpose, according to the invention, the casing of the main hammer cylinder is externally provided with an annular projection, and the surface of the bearing frame mating with the surface of the hammer cylinder casing is provided with an annular groove accommodating the annular projection which divides the groove into two chambers for fluid which causes the adjustable axial movement of the casing of the main hammer cylinder.

Such technical solution enables considerably reducing the mass acting on the blank during deformation thereof and makes it possible to impart to the hammer body preset impact velocity and energy by means of a comparatively light-weight hammer piston. In this case by selecting an appropriate quantity of an explosive and the value of pressure under which it is fed to the explosion chamber, a pre-set impact energy with a pre-set impact velocity may be imparted to the hammer body. Thus, parts of various size and shape may be treated in the hammer according to the invention, thereby considerably enlarging its manufacturing capabilities.

The possibility of axial adjustment of the casing of the main hammer cylinder permits the upper die to be moved to the blank accommodated on the lower die at a distance smaller than the length of the piston stroke of the auxiliary hammer cylinder.

Besides, such technical solution of returning the hammer body back into the initial position enables the elimination of hydraulic cylinders in the bottom portion of the load bearing frame thereby leaving free the zone of blank deformation.

An elastic body is preferably accommodated in the upper chamber of the auxiliary hammer cylinder for the action of the hammer piston therethrough on the piston of this hammer cylinder.

This facility provides for using pistons of the auxiliary hammer cylinder having the cross-sectional area equal to or substantially different from the cross-sectional ara of the hammer piston so as to vary the impact energy with the same impact velocity.

Furthermore, the provision of the elastic body between the hammer piston and the piston of the auxiliary hammer cylinder ensures the reduction of stresses in the hammer piston and in the piston upon their impact thus lowering wear of the hammer piston and piston and improving reliability of the hammer.

The elastic body preferably is liquid. This technical solution provides for simplicity of obtaining a desired shape of the elastic body, facilitates filling of the inner space of varying cross-section and ensures low coefficient of friction.

According to the invention, the ratio of mass of the piston of the auxiliary hammer cylinder and the upper die to mass of the hammer piston is equal to the ratio of second powers of cross-sectional areas of the piston and hammer piston.

The cross-sectional area of the piston of the auxiliary hammer cylinder is preferably equal to the cross-sectional area of the hammer piston.

The cross-sectional area of the piston of the auxiliary hammer cylinder may be substantially smaller than that of the hammer piston.

The cross-sectional area of the piston of the auxiliary cylinder may also be substantially greater than that of the hammer piston.

The above-mentioned technical solutions permit an impact energy to be imparted to the piston of the auxiliary hammer cylinder which may be varied over a wide range with the same impact velocity of the upper die at the blank by varying the kinetic energy and speed of movement of the hammer piston. Thus, by using pistons of different cross-sectional area, the same hammer may be used for treating blanks of various size and shape thereby considerably increasing the manufacturing capabilities of the hammer.

In accordance with the invention, the ratio of masses of the piston of the auxiliary hammer cylinder and the upper die and of the hammer piston may be smaller than the ratio of second powers of the cross-sectional areas of the piston and hammer piston, the hammer piston thus being capable of imparting an additional pressure impulse to the upper die.

This facility makes it possible to treat parts by applying a double impact with a short-time interval between the blows. The opportunity of changing the ratio of values of these impacts also enlarges the manufacturing capabilities of the hammer.

The ratio of mass of the piston of the auxiliary hammer cylinder and the upper die to mass of the hammer piston may be greater than the ratio of second powers of cross-sectional areas of the piston and hammer piston the inner space of the piston rod of the main hammer cylinder communicating with atmosphere via a passage provided in the wall of said piston rod at a distance from the end thereof which is slightly greater than the length of the hammer piston.

With such technical solution, the hammer piston may be returned back into the initial position under the action of elastic forces developing in the elastic body upon interaction of the hammer piston and piston of the auxiliary hammer cylinder through the elastic body. The hammer piston moving down below this passage provides for communication of the piston rod inner space with atmosphere, whereby gases from the explosion chamber and the inner space of the piston rod are discharged through this passage into atmosphere, the pressure over the hammer piston drops and does not hamper the return of the hammer piston back into the initial position. This also results in improved performance of the hammer.

According to the invention, the hammer piston and the hollow piston rod having an auxiliary hammer cylinder fixed thereto are mounted for a combined movement in the main hammer cylinder which has a lower piston chamber communicating with the air line incorporating a known per se device for reducing pressure in the lower piston chamber so that, as a result of the combined movement, the upper die is caused to approach the blank to come into contact therewith and to effect high-speed deformation of the blank under the action of the hammer piston on the piston of the auxiliary hammer cylinder through the elastic body. It permits high-speed deformation of the blank with the speed increasing from zero to preset value.

This technical solution permits blanks of the type of single-tailed blades of low-ductility materials to be treated in the hammer according to the invention with small deformations of the material and at relatively high velocity of deformation due to the action of inertia forces developing in the blank during deformation thereof. In this case, due to the action of inertia forces developing in the blank during deformation thereof, deformation forces are considerably reduced, and, due to minimum initial velocity of deformation, the loss of stability of the blank and upset of the blade fin during acceleration to a pre-set velocity are eliminated. This also enlarges the manufacturing capabilities of the hammer and considerably improves quality of parts.

BRIEF DESCRIPTION OF THE ACCOMPANYING DRAWINGS

The invention will be described with reference to a specific embodiment thereof illustrated in the accompanying drawings, in which.

Figure 1:
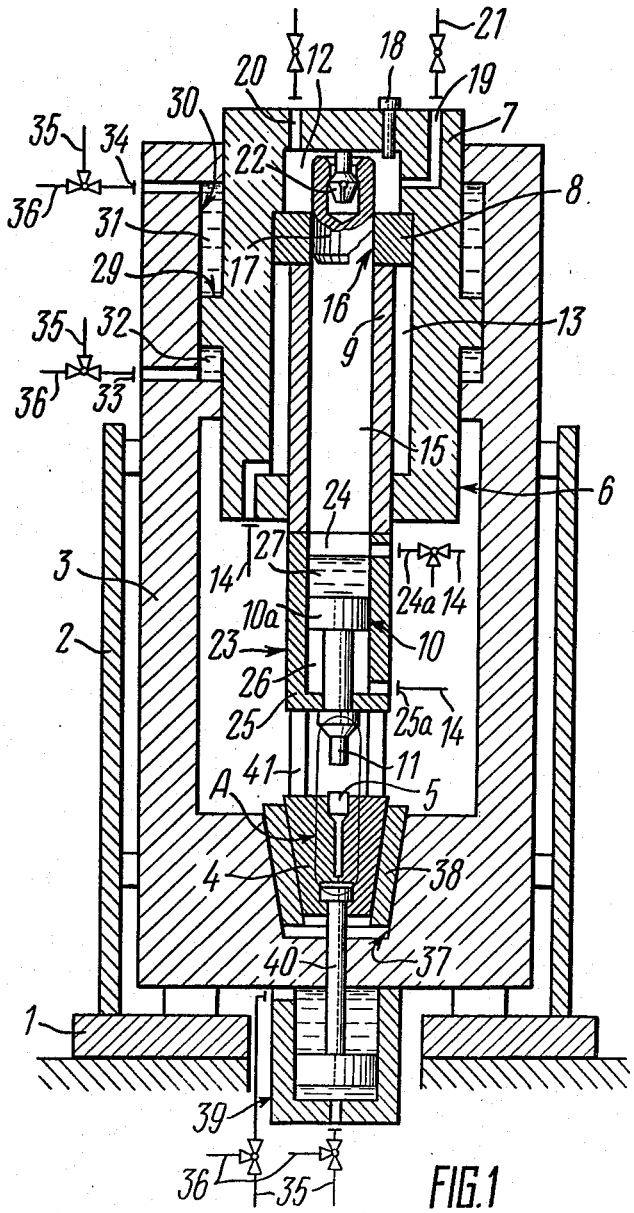
FIG. 1 is a diagrammatic vertical section of the high-speed explosive hammer according to the invention
Figure 5:
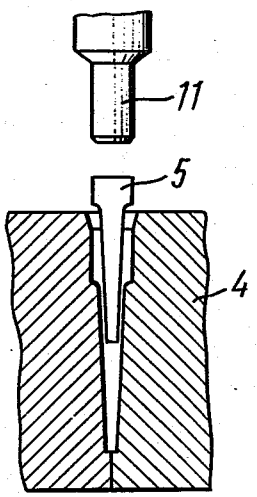
Figure 4:
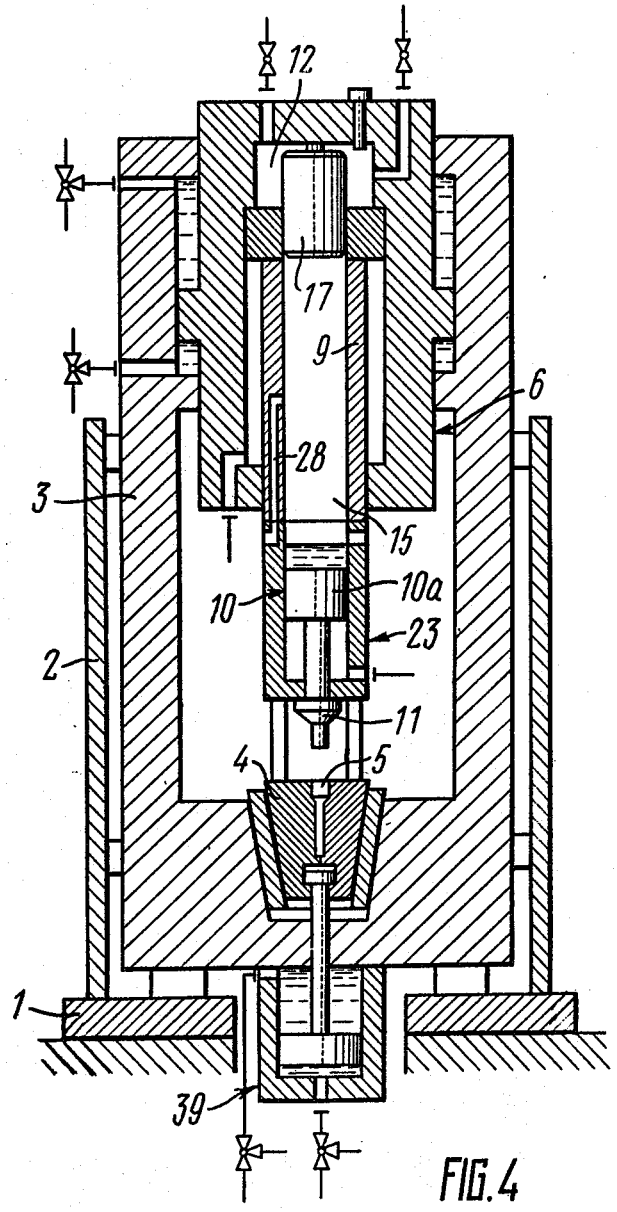

FIG. 4 diagrammatically shows the high-speed explosive hammer having the hollow piston rod with the inner space communicating with atmosphere;

FIG. 5 is an enlarged detail A in FIG. 1.

DETAILED DESCRIPTION OF THE DRAWINGS

The high-speed explosive hammer comprises a stationary bed 1 (FIG. 1) which is rigidly fixed to a foundation (not shown). The bed 1 has guides 2 in which a load bearing frame 3 is mounted in a known manner. The bottom portion of the load bearing frame 3 accommodates a lower die 4 containing a blank 5. The top portion of the load bearing frame 3 accommodates a main hammer cylinder 6. A casing 7 of the main hammer cylinder 6 comprises a sleeve which is mounted for axial movement with its bottom wall up. A piston 8 of the main hammer cylinder 6 has a hollow piston rod 9 supporting, at the free end thereof, a hammer body 10 carrying an upper die 11.

The hammer body 10 and the upper die 11 are mounted coaxially with the lower die 4. The upper chamber of the main hammer cylinder 6 comprises an explosion chamber 12. A lower chamber 13 of the main hammer cylinder 6 communicates with an air line 14 to be filled with gas under pressure. Thus, the piston 8 of the main hammer cylinder 6 can be held in the initial uppermost position.

According to the invention, the hammer body 10 is mounted in an inner space 15 of the piston rod 9 for an independent axial movement relative thereto. The piston 8 has a central opening 16 for connecting the inner space 15 of the piston rod 9 to the explosion chamber 12.

The inner space 15 accommodates, over the hammer body 10, a cylindrical hammer piston 17. The hammer piston 17 is mounted for movement along the inner space 15 from the initial position (at the piston 8) under the action of pressure of gases released in the explosion chamber 12 upon combustion of an explosive.

The bottom wall of the casing 7 of the main hammer cylinder 6 incorporates an electric igniter 18 (as shown in FIG. 1). Besides, the bottom wall of the casing 7 has two openings 19 and 20. The chamber 12 communicates, via the opening 19, with a pipeline 21 for feeding an explosive to the chamber 12. The opening 20 is used for discharge of combustion products of the explosive. An expansion sleeve means 22 for holding the hammer piston 17 in the uppermost position is internally secured to the bottom wall of the casing 7 of the main hammer cylinder at the center thereof. The upper end of the hammer piston 17 has a profiled opening to receive the expansion sleeve 22 as shown in FIG. 1.

The free end of the hollow piston rod 9 carries an auxiliary hammer cylinder 23. An upper chamber 24 of the auxiliary hammer cylinder 23 is an extension of the inner space 15 of the hollow piston rod 9. The diameters of the inner space 15 and upper chamber 24 are identical.

According to the invention, the hammer body 10 comprises a piston of the auxiliary hammer cylinder 23 and will be referred to hereinafter as the piston 10*a*. The upper portion of a casing 25 of the auxiliary hammer cylinder 23 incorporates a connector 24*a* for communication of the upper chamber 24 with the air line 14 at regular intervals to return the hammer piston 17 back into the initial position. The lower portion of the casing 25 incorporates a connector 25*a* for permanent communication of a lower chamber 26 of the auxiliary hammer cylinder 23 with the air line 14 to return the piston 10*a* back into the initial position.

According to the invention, the upper chamber 24 of the auxiliary hammber cylinder 23 accommodates an elastic body 27 so that the hammer piston 17 acts on the piston 10*a* through this elastic body.

The elastic body 27 may be either of rubber or a liquid.

Figure 3:
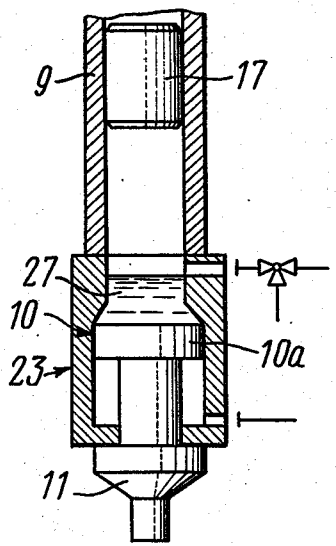
FIG. 3 is an enlarged diagrammatic view of the auxiliary hammer cylinder with a piston of a diameter which is greater than the diameter of the hammer piston, according to the invention.
Figure 2:
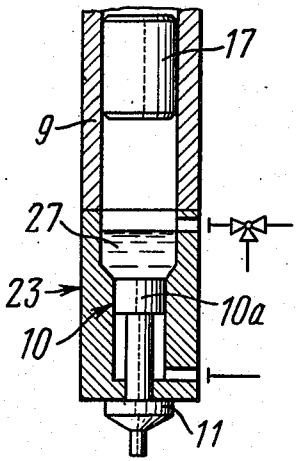
FIG. 2 is an enlarged diagrammatic view of the auxiliary hammer cylinder having a piston of a diameter smaller than the diameter of the hammer piston, according to the invention.

According to the invention, the dimensions of the piston 10*a*, auxiliary hammer cylinder 23 and hammer piston 17, as well as materials for their manufacture are selected such that the ratio of mass of the piston 10*a* of the auxiliary hammer cylinder 13 and the upper die 11 to mass of the hammer piston 17 is equal to the ratio of second powers of cross-sectional areas of the piston 10*a* and the hammer piston 17. It should be noted that cross-sectional area of the piston 10*a* (FIG. 2) is substantially smaller than cross-sectional area of the hammer piston 17. Cross-sectional area of the piston 10*a* may also be equal to cross-sectional area of the hammer piston 17 as shown in FIG. 1. Moreover, cross-sectional area of the piston 10*a* may be substantially greater than that of the hammer, piston 17 as shown in FIG. 3.

In the hammer of the present invention, the dimensions of the piston 10*a* (FIG. 1) of the auxiliary hammer cylinder 23 and of the hammer piston 17, as well as materials for their manufacture are selected such that the ratio of mass of the piston 10*a* and the upper die 11 to mass of the hammer piston 17 is smaller than the ratio of second powers of cross-sectional areas of the piston 10*a* and the hammer piston 17. Thus, the hammer piston 17 is capable of imparting to the upper die 11, through the elastic body 27, an additional pressure impulse.

Moreover, the dimensions of the piston 10*a* of the auxiliary hammer cylinder 23 and of the hammer piston 17, as well as materials of which they are manufactured may be selected such that the ratio of mass of the piston 10*a* and the upper die 11 to mass of the hammer piston 17 is greater than the ratio of second powers of cross-sectional areas of the piston 10*a* and the hammer piston 17. In such an embodiment, the wall of the hollow piston rod 9 has a passage 28 (as shown in FIG. 4). The opening of the passage 28 terminating in the inner space 15 of the hollow piston rod 9 is located at a distance from the end thereof which is slightly greater than the length of the hammer piston 17. The inner space 15 of the piston rod 9 communicates, via this passage 28, with atmosphere for discharge of gases released in the explosion chamber 12 from this inner space at the lowermost position of the hammer piston 17.

The hammer piston 17 and the hollow piston rod 9 carrying the auxiliary hammer cylinder fixed thereto are mounted for a combined movement in the main hammer cylinder 6, and for that purpose, any appropriate known device for reducing pressure in the lower piston chamber 13 is incorporated in the air line 14 communicating with the lower piston chamber 13 of the main hammer cylinder. As a result of the combined movement, the upper die 11 is caused to approach the blank 5 to come into contact therewith and to effect high-speed deformation of the blank with the speed increasing from zero to a pre-set value under the action of the hammer piston 17 on the piston of the auxiliary hammer cylinder 23 through the elastic body 27.

The casing 7 of the main hammer cylinder 6 is externally provided with an annular projection 29 (FIG. 1). The load bearing frame 3 is provided, on the surface thereof mating with the outer surface of the casing 7 of the main hammer cylinder 6, with an annular groove 30 for accommodation of the annular projection 29. The annular projection 29 divides the annular groove 30 into two chambers 31 and 32 filled with fluid for adjustably moving the casing 7 of the main hammer cylinder 6. The fluid may be liquid.

Two connectors 33 and 34 for alternately connecting the chambers 31 and 32 to high and low pressure hydraulic lines 35 and 36, respectively, are mounted in the top portion of the load bearing frame 3 opposite to the chambers 31 and 32.

A blind tapered bore 37 is made in the bottom portion of the load bearing frame 3 to receive the lower die 4. The bore 37 accommodates a conical bushing 38 in which the lower die having a tapered periphery is mounted for axial movement.

An actuating cylinder 39 is mounted to the lower side of the load bearing frame 3 coaxially with the conical bushing 38. A piston rod 40 of the actuating cylinder 39 is secured, with the free end thereof, to the lower die 4 in a manner known per se for axially moving the die.

Operation of the Hammer

In the initial position, the piston 8 (FIG. 1) of the main hammer cylinder 6 and the piston 10*a* of the auxiliary hammer cylinder 23 are in the uppermost position under the action of compressed gas. The hammer piston 17 is in the uppermost position and is held in the position by the expansion sleeve means 22. Stops 41 are mounted to the lower end of the casing 25 of the auxiliary hammer cylinder 23, the length of the stops slightly exceeding the height of the upper die 11.

The chamber 31 (FIG. 1) is connected to the high pressure hydraulic line 35, and the chamber 32 is connected to the lower pressure hydraulic line 36. As a result, the main hammer cylinder 6 moves down until the stops 41 engage the upper end of the lower die 4. An explosive is admitted to the explosion chamber 12 through the opening 19 along the pipeline 21, and the opening 19 is then closed. The opening 20 is also closed.

The inner space 15 of the piston rod 9 communicates with atmosphere through the connector 24a.

The preheated blank 5 is mounted in the lower die 4.

The operation of the hammer according to the invention will be described as applied to the extrusion of single-tailed blades for a gas turbine engine. The lower die 4 comprises a split two-section female die having a vertical split plane, and the upper die 11 comprises a male die.

Voltage is applied to the electric detonator 18, and the explosive charge is initiated. A blow-up occurs. Gases released upon the blow-up act on the upper end of the hammer piston 17.

Under the action of gas pressure, the hammer piston 17 moves towards the piston 10a and acts thereon through the elastic body 27. As a result, the male die fixed to the piston 10a moves therewith towards the blank 5 and acts thereon at pre-set impact velocity and energy to deform the blank. In this case the ratio of mass of the piston 10a and the upper die 11 to mass of the hammer piston 17 is equal to the ratio of second powers of cross-sectional areas of the piston 10a and hammer piston 17. Thus, the hammer piston 17 is stopped after it hits upon the piston 10a through the elastic body 27 and completely transmits its kinetic energy to the piston 10a.

With comparatively small kinetic energy imparted to the hammer piston 17 by gas pressure, the hammer piston 17 gains comparatively low speed which is not sufficient to ensure high-speed deformation of the blank. Therefore, in the manufacture of single-tailed blades with a comparatively low impact energy, the piston 10a (FIG. 2) of the auxiliary hammer cylinder 23 is used, which has cross-sectional area substantially smaller than cross-sectional area of the hammer piston 17.

The hammer may also have the piston 10a (FIG. 1) of cross-sectional area equal to cross-sectional area of the hammer piston 17 so that when the kinetic energy imparted to the hammer piston 17 by gas pressure is equal to the impact energy, the speed of movement of the hammer piston 17 is within the range of pre-set impact velocity. It should be noted that the speed of movement of the hammer piston 17 by the moment of its interaction with the piston 10a through the elastic body 27 is equal to the speed of the male die.

If the kinetic energy sufficient to provide a comparatively high impact energy of the male die is imparted to the hammer piston 17, the hammer piston 17 gains the speed of movement which is greater than a pre-set impact velocity. Therefore, in such case, the hammer is used with the piston 10a (FIG. 3) of a cross-sectional area which is substantially greater than that of the hammer piston 17. This facility ensures the speed of movement of the piston 10a which is substantially smaller than that of the hammer piston 17. In other words, in all the above cases, the speed of the piston 10a remains unchanged despite substantial changes in its kinetic energy, hence the impact energy of the male die, by merely changing the cross-sectional dimensions of the piston 10a.

The dimensions of the piston 10a and hammer piston 17, as well as materials for their manufacture are selected such that the ratio of mass of the piston 10a and the upper die to mass of the hammer piston 17 is smaller than the ratio of second powers of cross-sectional areas of the piston 10a and the hammer piston 17. It should be noted that the hammer piston 17 retains a fraction of its kinetic energy after it hits upon the piston 10a through the elastic body 27, while a speed greater than that of the hammer piston 17 is imparted to the piston 10a. As a result, the piston 10a is disengaged from the hammer piston 17, and they move towards the blank 5 in a spaced relationship to each other. Then the male die secured to the piston 10a hits against the blank 5 to deform it at a pre-set impact velocity and is stopped. The hammer piston 17 continues to move, approaches the piston 10a with the kinetic energy remaining after the interaction with the piston 10a and transmits a second blow to impart to the male die, hence to the blank 5, an additional pressure impulse.

After the repeated blow imparted by the hammer piston 17 to the piston 10a, the hammer piston 17 and the piston 10awith the male die are stopped in the lowermost position.

The opening 20 is opened, and gases and combustion products are discharged from the explosion chamber 12 into atmosphere.

Under the action of compressed gas pressure in the lower chamber 26 in permanent communication with the air line 14, the piston 10a and the male die are lifted to the uppermost position. The hammer piston 17 is lifted concurrently with the piston 10a. The chamfered lower end of the hammer piston 17 is positioned opposite to the connector 24a. The upper chamber 24 is connected to the air line 14 through the connector 24a. Under the action of gas, the hammer piston 17 is lifted to the uppermost position in which it is retained by the expansion sleeve means 22.

Then the chamber 32 is communicated with the high pressure hydraulic line 35, and the chamber 31 is communicated with the low pressure hydraulic line 36. As a result, the main hammer cylinder 6 is lifted to the uppermost position.

Subsequently the actuating cylinder 39 is put on. The piston rod 40 of the actuating cylinder 39 is lifted to eject the lower die 4 (female die) from the conical bushing 38. The female die is opened, and the finished part is removed therefrom. Then the actuating cylinder is reversed, and the female die is retracted into the conical bushing 38. The opening 20 is closed. The operation cycle of the hammer is completed. The hammer may function in both automatic and semiautomatic mode (the adjustment of the hammer is effected manually).

With the ratio of mass of the piston 10a and the upper die 11 to mass of the hammer piston greater than the ratio of second powers of cross-sectional areas of the piston 10a and the hammer piston 17, the hammer piston 17 returns back into the uppermost position on its own. After it hits upon the piston 10a through the elastic body 27, the hammer piston 17 acquires a kinetic energy under the action of elastic forces developing in the elastic body 27. Under the action of this kinetic energy, the hammer piston 17 "springs back" from the elastic body 27 and returns back into the uppermost position in which it is held by the expansion sleeve means 22.

At the moment, when the hammer piston 17 is in the lowermost position, its upper end is located below the opening of the passage 28 to open it for discharge of gases from the inner space 15 of the piston rod 9 into atmosphere. Threfore, the gas pressure in the inner space 15 drops and does not hamper the return of the hammer piston 17 back into the uppermost position under the action of forces developing in the elastic body 27.

After the blank 5 is deformed by the upper die 11, the piston 10*a* returns back into the initial position under the action of compressed gas in the lower chamber 26.

The return of the main hammer cylinder 6, removal of finished part from the lower die 4 and preparation of the hammer to the next cycle of operation are effected as described above.

High-speed deformation of the blank 5 with the speed increasing from zero to a pre-set value may be effected in the hammer according to the invention, and for that purpose, the upper die 11 is preliminarily positioned at the blank 5. This is accomplished in the following manner. The main hammer cylinder 6 is lowered down as described above. A distance sufficient to accommodate in the die 4 of the preheated blank 5 is adjusted between the upper and lower dies, or the male die and female die, respectively. In this case, the blank 5 is a preformed single-tailed blade. The blank 5 is placed in the female die (as shown in FIG. 5), and an explosive is blown-up in the exploded chamber 12. At the same time, the pressure in the lower chamber 13 of the main hammer cylinder 5 is lowered. Thus, both the piston 8 with the hollow piston rod 9 and auxiliary hammer cylinder 23, and the hammer piston 17 concurrently move towards the blank 5.

The hollow piston rod 9 moves until the stops 41 come in contact with the female die. At the same time, the male die comes in contact with the tail end of the single-tailed blade. In this position, the piston 10*a* and the piston rod 9 are stopped.

The hammer piston 17 approaches the piston 10*a* and hits thereupon through the elastic body 27 to cause the piston 10*a* to move at a speed increasing from zero to a pre-set value. Therefore, the impact at the tail end is prevented, hence there is no loss of stability or distortion of the blade. Moreover, deformation of the blank 5 at such speed of movement of the upper die 11 also eliminates the possibility of cracking and scaling in the zone of the blade tail.

Under the action of the male die, the blade is pressed in the cavity of the female die at high velocity for final deformation of the blade, e.g. for sizing.

After the gases leave the explosion chamber 12, the pistons 8 and 10*a* return back into the initial position.

The female die is ejected, and the sized blade is removed. The cycle of treatment of the blank 5 is completed. The next cycle is repeated as described above.

It should be born in mind that the above examples do not limit the field of application of the invention.

We claim:

1. A high-speed explosive hammer comprising: a stationary bed; a load bearing frame incorporated in said bed; a lower die mounted in said load bearing frame; a main hammer cylinder mounted in said load bearing frame and having a piston with a hollow piston rod having an inner space, and an upper chamber comprising an explosion chamber; a hammer body coaxial with said lower die on said hollow piston rod; an upper die mounted on said hammer body; said hammer body being mounted in said inner space of said hollow piston rod for an independent axial movement relative thereto; a hammer piston accommodated in said inner space of said hollow piston rod above said hammer body; said hammer piston being caused to move by pressure of gases released upon a blow-up in the explosion chamber to cause the axial movement of said hammer body for acting upon the blank; a central opening provided in said piston for establishing communication of said explosion chamber with the inner space of said hollow piston rod.

2. A hammer according to claim 1 wherein said main hammer cylinder includes a casing which is axially adjustable, and wherein said hammer further comprises an auxiliary hammer cylinder fixed to said hollow piston rod; a piston of said auxiliary hammmer cylinder constituting said hammer body; an upper chamber of said auxiliary hammer cylinder being an extension of said inner space of said hollow piston rod, said upper chamber being communicable with an air line to return said hammer piston back into the initial position; a lower chamber of said auxiliary hammer cylinder communicating with the air line to return said auxiliary hammer cylinder piston back into the initial position.

3. A hammer according to claim 2 wherein said casing of said main hammer cylinder is mounted in said load bearing frame; said load bearing frame having a surface mating with the outer surface of said casing of said main hammer cylinder; an annular projection provided on the outer surface of said casing of said main hammer cylinder; an annular groove in the surface of said load bearing frame mating with the outer surface of said casing; said annular groove accommodating said annular projection which divides the groove into two fluid chambers, the fluid causing the movement of said casing of said main hammer cylinder for its axial adjustment.

4. A hammer according to claim 2, further comprising an elastic body positioned in said upper chamber of said auxiliary hammer cylinder, said hammer piston acting on said piston of said auxiliary hammer cylinder through said elastic body.

5. A hammer according to claim 4, wherein said elastic body is liquid.

6. A hammer according to claim 4, wherein the ratio of mass of said piston of the auxiliary hammer cylinder and upper die to the mass of said hammer piston is smaller than the ratio of second powers of the piston and hammer piston, respectively, so that the hammer piston is capable of imparting to said upper die an additional pressure impulse.

7. A hammer according to claim 4, further comprising a passage provided in the wall of said piston rod at a distance from the end thereof which is slightly greater than the length of said hammer piston, the ratio of mass of said piston and said upper die to the mass of said hammer pison being greater than the ratio of second powers of cross-sectional areas of said piston and hammer piston.

8. A hammer according to claim 4, wherein said hammer piston and said hollow piston rod having the auxiliary hammer cylinder fixed thereto are mounted for a combined movement in said main hammer cylinder, and wherein said main hammer cylinder further comprises a lower piston chamber communicating with the air line incorporating means for reducing pressure in said lower piston chamber so that, as a result of said combined movement, the upper die is caused to approach the blank to come into contact therewith and to effect high-speed deformation thereof under the action of the hammer piston to the piston of the auxiliary hammer cylinder through the elastic body.

9. A hammer according to claim 4, wherein said hollow piston rod together with said auxiliary hammer cylinder and upper die are mounted for moving simultaneously with said hammer piston under the action of pressure of gases released in the explosion chamber so that the upper die approaches the blank for contact therewith, whereby high-speed deformation of the blank is effected by action of the hammer piston on the piston of the auxiliary hammer cylinder through the elastic body at a velocity increasing from aboout zero to 70–100 m/s.

10. A hammer according to claim 4, wherein the ratio of mass of said piston and said upper die to the mass of said hammer piston is equal to the ratio of second powers of cross-sectional areas of the piston and hammer piston.

11. A hammer according to claim 10, wherein the cross-sectional area of said piston of said auxiliary hammer cylinder is equal to the cross-sectional area of said hammer piston.

12. A hammer according to claim 10, wherein the cross-sectional area of said piston of said auxiliary hammer cylinder is substantially smaller than the cross-sectional area of said hammer piston.

13. A hammer according to claim 10, wherein the cross-sectional area of said piston of said auxiliary hammer cylinder is substantially greater than the cross-sectional area of said hammer piston.

* * * * *